US011891867B2

(12) United States Patent
Fripp et al.

(10) Patent No.: US 11,891,867 B2
(45) **Date of Patent: *Feb. 6, 2024**

(54) EXPANDABLE METAL WELLBORE ANCHOR

(71) Applicant: Halliburton Energy Services, Inc., Houston, TX (US)

(72) Inventors: Michael Linley Fripp, Carrollton, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 324 days.

This patent is subject to a terminal disclaimer.

(21) Appl. No.: 16/666,713

(22) Filed: Oct. 29, 2019

(65) Prior Publication Data

US 2021/0123310 A1 Apr. 29, 2021

(51) Int. Cl.

| | |
|---|---|
| ***E21B 23/04*** | (2006.01) |
| ***E21B 33/129*** | (2006.01) |
| ***E21B 23/01*** | (2006.01) |
| ***E21B 33/12*** | (2006.01) |

(52) U.S. Cl.

CPC ..... *E21B 23/04* (2013.01); *E21B 23/01* (2013.01); *E21B 23/0411* (2020.05); *E21B 33/129* (2013.01); *E21B 33/12* (2013.01)

(58) Field of Classification Search

CPC ..... E21B 23/04; E21B 23/0411; E21B 23/01; E21B 33/129; E21B 33/12; E21B 33/1208

See application file for complete search history.

(56) References Cited

U.S. PATENT DOCUMENTS

| | | | | |
|---|---|---|---|---|
| 4,270,608 | A * | 6/1981 | Hendrickson | E21B 23/006 166/278 |
| 8,993,491 | B2 * | 3/2015 | James | E21B 33/12 507/225 |
| 9,404,030 | B2 * | 8/2016 | Mazyar | C09K 8/516 |
| 9,708,880 | B2 * | 7/2017 | Solhaug | E21B 23/06 |
| 9,732,578 | B2 * | 8/2017 | McRobb | E21B 33/12 |
| 10,364,636 | B2 * | 7/2019 | Davis | E21B 23/01 |
| 10,758,974 | B2 * | 9/2020 | Sherman | C22C 23/00 |
| 11,359,448 | B2 * | 6/2022 | Fripp | E21B 33/12 |
| 11,512,552 | B2 * | 11/2022 | Fripp | C09K 8/516 |
| 2006/0272806 | A1 | 12/2006 | Wilkie et al. | |
| 2007/0277979 | A1 | 12/2007 | Todd et al. | |
| 2009/0250228 | A1 * | 10/2009 | Loretz | E21B 33/12 166/387 |
| 2010/0257913 | A1 | 10/2010 | Storm, Jr. et al. | |

(Continued)

FOREIGN PATENT DOCUMENTS

WO 2019164499 A1 8/2019

*Primary Examiner* — Jonathan Malikasim

(74) *Attorney, Agent, or Firm* — Scott Richardson; Parker Justiss, P.C.

(57) ABSTRACT

Disclosed herein are aspects of an expandable metal wellbore anchor for use in a wellbore. The expandable metal wellbore anchor, in one aspect, includes one or more expandable members positionable on a downhole conveyance member in a wellbore, wherein the one or more expandable members comprise a metal configured to expand in response to hydrolysis, and wherein a combined volume of the one or more expandable members is sufficient to expand to anchor one or more downhole tools within the wellbore in response to the hydrolysis.

25 Claims, 5 Drawing Sheets

(56) References Cited

U.S. PATENT DOCUMENTS

| | | | | |
|---|---|---|---|---|
| 2013/0012824 | A1 | 1/2013 | Vanney et al. | |
| 2013/0152824 | A1* | 6/2013 | Crews | C04B 14/34 106/641 |
| 2014/0262352 | A1 | 9/2014 | Lembcke | |
| 2016/0137912 | A1 | 5/2016 | Sherman et al. | |
| 2016/0230495 | A1 | 8/2016 | Mazyar et al. | |
| 2017/0350237 | A1 | 12/2017 | Giem et al. | |
| 2018/0087350 | A1* | 3/2018 | Sherman | E21B 43/086 |
| 2018/0298708 | A1 | 10/2018 | Schmidt et al. | |
| 2021/0332673 | A1* | 10/2021 | Fripp | E21B 33/1212 |

* cited by examiner

EXPANDABLE METAL WELLBORE ANCHOR

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as frac plugs, bridge plugs, packers, and other suitable tools, may be used to isolate wellbore sections.

The aforementioned downhole, tools are commonly run into the wellbore on a conveyance, such as a wireline, work string or production tubing. Such tools typically have either an internal or external setting tool, which is used to set the downhole tool within the wellbore and hold the tool in place, and thus function as a wellbore anchor. The wellbore anchors typically include a plurality of slips, which extend outwards when actuated to engage and grip a casing within a wellbore or the open hole itself, and a sealing assembly, which can be made of rubber and extends outwards to seal off the flow of liquid around the downhole tool. Notwithstanding the foregoing, today's wellbore anchors have a difficult time sealing off the roughened or scaled surfaces of the casing, as well as have difficulty in open hole scenarios.

What is needed in the art is an improved wellbore anchor that does not experience the drawbacks of existing devices.

BRIEF DESCRIPTION

Figure 1:
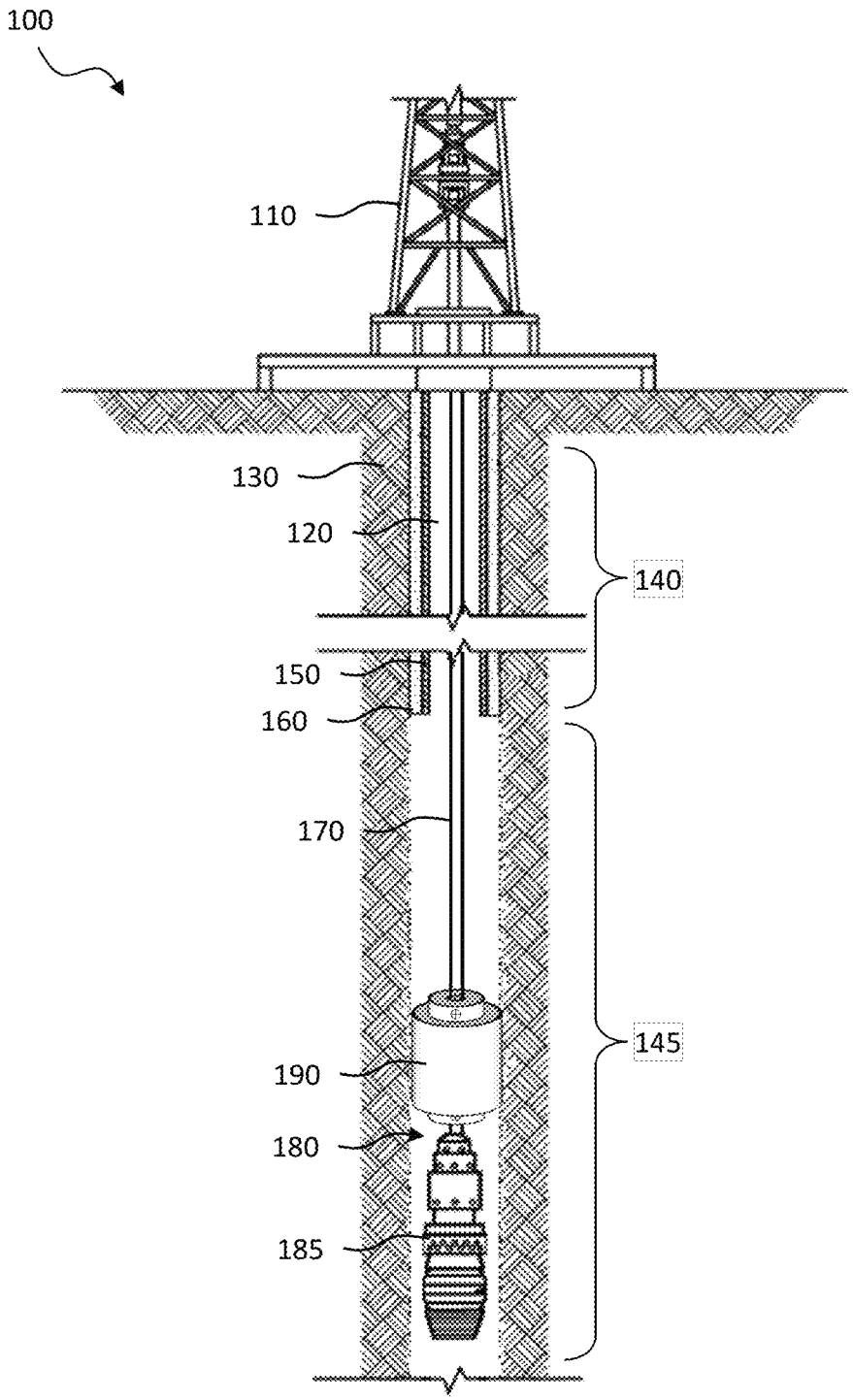

Reference is now made to the following descriptions taken in conjunction with the accompanying drawings, in which:

FIG. 1 is a perspective view of a well system including an exemplary operating environment that the apparatuses, systems and methods disclosed herein may be employed; and FIGS. 2-9 illustrate various different configurations for an expandable metal wellbore anchor designed and manufactured according to the disclosure.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Referring to FIG. 1, depicted is a perspective view of a well system 100 including an exemplary operating environment that the apparatuses, systems and methods disclosed herein may be employed. For example, the well system 100 could use an expandable metal wellbore anchor according to any of the embodiments, aspects, applications, variations, designs, etc. disclosed in the following paragraphs. The well system 100 illustrated in FIG. 1 includes a drilling rig 110 extending over and around a wellbore 120 formed in a subterranean formation 130. As those skilled in the art appreciate, the wellbore 120 may be fully cased, partially cased, or an open hole wellbore. In the illustrated embodiment of FIG. 1, the wellbore 120 is partially cased, and thus includes a cased region 140 and an open hole region 145. The cased region 140, as is depicted, may employ casing 150 that is held into place by cement 160.

The well system 100 illustrated in FIG. 1 additionally includes a downhole conveyance 170 deploying a downhole tool assembly 180 within the wellbore 120. The downhole conveyance 170 can be, for example, tubing-conveyed, wireline, slickline, work string, or any other suitable means for conveying the downhole tool assembly 180 into the wellbore 120. In one particular advantageous embodiment, the downhole conveyance 170 is American Petroleum Institute "API" pipe.

The downhole tool assembly 180, in the illustrated embodiment, includes a downhole tool 185 and an expandable metal wellbore anchor 190. The downhole tool 185 may comprise any downhole tool that could be anchored within a wellbore. Certain downhole tools that may find particular use in the well system 100 include, without limitation, sealing packers, elastomeric sealing packers, non-elastomeric sealing packers (e.g., including plastics such as PEEK, metal packers such as inflatable metal packers, as well as other related packers), liners, an entire lower completion, one or more tubing strings, one or more screens, one or more production sleeves, etc.

The expandable metal wellbore anchor 190, in accordance with the disclosure, includes one or more expandable members positioned on the downhole conveyance 170. In some embodiments, all or part of the expandable metal wellbore anchor 190 may be fabricated using an expanding metal configured to expand in response to hydrolysis. The expanding metal, in some embodiments, may be described as expanding to a cement like material. In other words, the metal goes from metal to micron-scale particles and then these particles expand and lock together to, in essence, lock the expandable metal wellbore anchor 190 in place. The reaction may, in certain embodiments, occur in less than 2 days in a reactive fluid and in downhole temperatures. Nevertheless, the time of reaction may vary depending on the reactive fluid, the expandable metal used, and the downhole temperature.

In some embodiments the reactive fluid may be a brine solution such as may be produced during well completion activities, and in other embodiments, the reactive fluid may be one of the additional solutions discussed herein. The metal, pre-expansion, is electrically conductive in certain embodiments. The metal may be machined to any specific size/shape, extruded, formed, cast or other conventional ways to get the desired shape of a metal, as will be discussed in greater detail below. Metal, pre-expansion, in certain embodiments has a yield strength greater than about 8,000 psi, e.g., 8,000 psi+/−50%. The metal, in this embodiment, has a minimum dimension greater than about 1.25 mm (e.g., approximately 0.05 inches).

The hydrolysis of any metal can create a metal hydroxide. The formative properties of alkaline earth metals (Mg—Magnesium, Ca—Calcium, etc.) and transition metals (Zn—Zinc, Al —Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O\text{->}Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O\text{->}Al(OH)_3+3/2H_2.$$

Another hydration reactions uses calcium hydrolysis. The hydration reaction for calcium is:

$$Ca+2H_2O\text{->}Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, gallium, indium, mercury, bismuth, tin, and Pd—Palladium. The metal alloy can be constructed in a solid solution process where the elements are combined with molten metal or metal alloy. Alternatively, the metal alloy could be constructed with a powder metallurgy process. The metal can be cast, forged, extruded, or a combination thereof.

Optionally, non-expanding components may be added to the starting metallic materials. For example, ceramic, elastomer, glass, or non-reacting metal components can be embedded in the expanding metal or coated on the surface of the metal. Alternatively, the starting metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expanding metal is formed in a serpentinite reaction, a hydration and metamorphic reaction. In one variation, the resultant material resembles a mafic material.

Additional ions can be added to the reaction, including silicate, sulfate, aluminate, and phosphate. The metal can be alloyed to increase the reactivity or to control the formation of oxides.

The expandable metal can be configured in many different fashions, as long as an adequate volume of material is available for fully expanding. For example, the expandable metal may be formed into a single long tube, multiple short tubes, rings, alternating steel and swellable rubber and expandable metal rings, among others. Additionally, a coating may be applied to one or more portions of the expandable metal to delay the expanding reactions.

In application, the expandable metal wellbore anchor 190 can be run in conjunction with cup packers or wipers to reduce/control crossflow during reaction time. Additionally, the expandable metal wellbore anchor 190 may be run between multiple short swell packers or swell rings to also reduce cross flow during the reaction. Many other applications and configurations are within the scope of the present disclosure.

The downhole tool assembly 180 can be moved down the wellbore 120 via the downhole conveyance 170 to a desired location. Once the downhole tool assembly 180, including the downhole tool 185 and the expandable metal wellbore anchor 190 reach the desired location, the expandable metal wellbore anchor 190 may be set in place according to the disclosure. In one embodiment, the expandable metal wellbore anchor 190 is subjected to a wellbore fluid sufficient to expand the one or more expandable members into contact with the wellbore 120 and thereby anchor the one or more downhole tools within the wellbore.

In the embodiment of FIG. 1, the expandable metal wellbore anchor 190 is positioned in the open hole region 145 of the wellbore 120. The expandable metal wellbore anchor 190 is particularly useful in open hole situations, as the expandable metal is well suited to adjust to the surface irregularities that may exist in open hole situations. Moreover, the expandable metal, in certain embodiments, may penetrate into the formation of the open hole region 145 and create a bond into the formation, and thus not just at the surface of the formation. Notwithstanding the foregoing, the expandable metal wellbore anchor 190 is also suitable for a cased region 140 of the wellbore 120.

Figure 2:
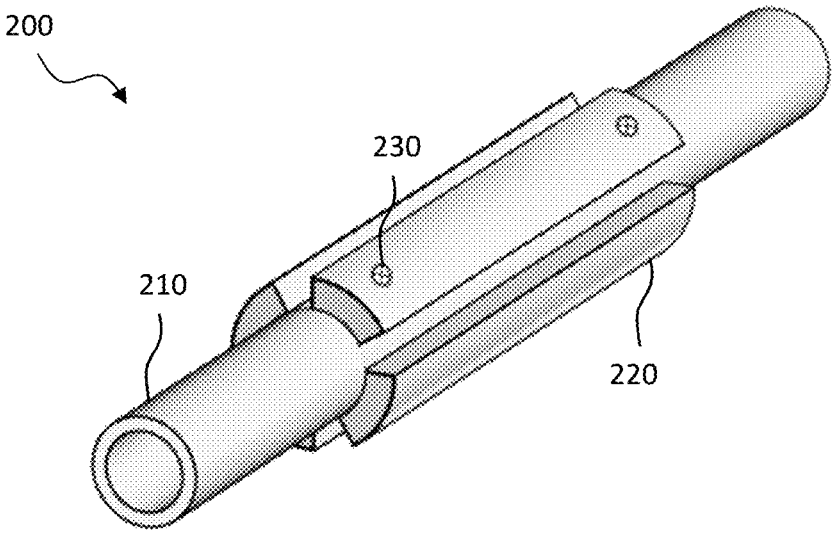

Turning to FIGS. 2-9, illustrated are various different configurations for an expandable metal wellbore anchor designed and manufactured according to the disclosure. Turning initially to FIG. 2, illustrated is an expandable metal wellbore anchor 200. In accordance with the disclosure, the expandable metal wellbore anchor 200 includes one or more expandable members 220 positioned on a downhole conveyance member 210. While the downhole conveyance member 210 illustrated in FIG. 2 is API pipe, other embodiments may exist wherein another type conveyance is used.

The one or more expandable members 220, in accordance with the disclosure, comprise a metal configured to expand in response to hydrolysis, as discussed in detail above. Furthermore, a combined volume of the one or more expandable members should be sufficient to expand to anchor one or more downhole tools within the wellbore in response to the hydrolysis. In one embodiment, the combined volume of the one or more expandable members 220 is sufficient to expand to anchor at least about 11,000 Kg (e.g., about 25,000 lbs.) of weight within the wellbore. In yet another embodiment, the combined volume of the one or more expandable members 220 is sufficient to expand to anchor at least about 22,000 Kg (e.g., about 50,000 lbs.) of weight within the wellbore, and in yet another embodiment sufficient to expand to anchor at least about 27,000 Kg (e.g., about 60,000 lbs.) of weight within the wellbore.

In the illustrated embodiment of FIG. 2, two or more expandable members 220 (e.g., four expandable members in the embodiment shown) are axially positioned along and substantially equally radially spaced about the downhole conveyance member 210. In the illustrated embodiment, the two or more expandable members 220 include openings extending entirely through a wall thickness thereof for accepting a fastener 230 (e.g., a set screw in one embodiment) for fixing to the downhole conveyance member 210. As those skilled in the art now appreciate, the two or more expandable members 220 will expand to engage with the wellbore when subjected to a suitable fluid, including a brine based fluid, and thus act as wellbore anchor.

Figure 3:
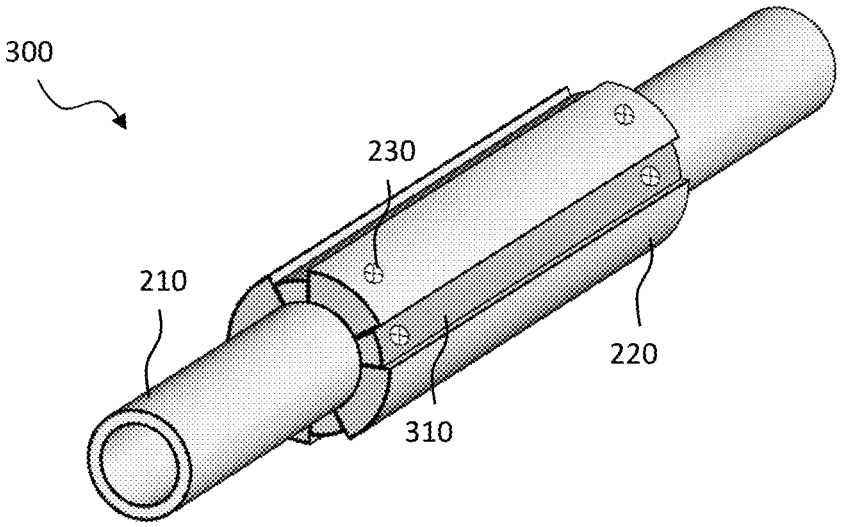

Turning briefly to FIG. 3, illustrated is an alternative embodiment of an expandable metal wellbore anchor 300. The expandable metal wellbore anchor 300 is similar in many respects to the expandable metal wellbore anchor 200. Accordingly, like reference numerals have been used to reference similar, if not identical, features. The expandable metal wellbore anchor 300 differs from the expandable metal wellbore anchor 200 primarily in that it includes two or more spacers 310 radially interleaving the two or more expandable members 220. The two or more spacers 310 may comprise a variety of different materials and remain within the scope of the disclosure. In the embodiment of FIG. 3, the two or more spacers 310 do not comprise the metal configured to expand in response to hydrolysis, and thus do not expand. For example, the two or more spacers 310 could comprise steel.

Figure 4:
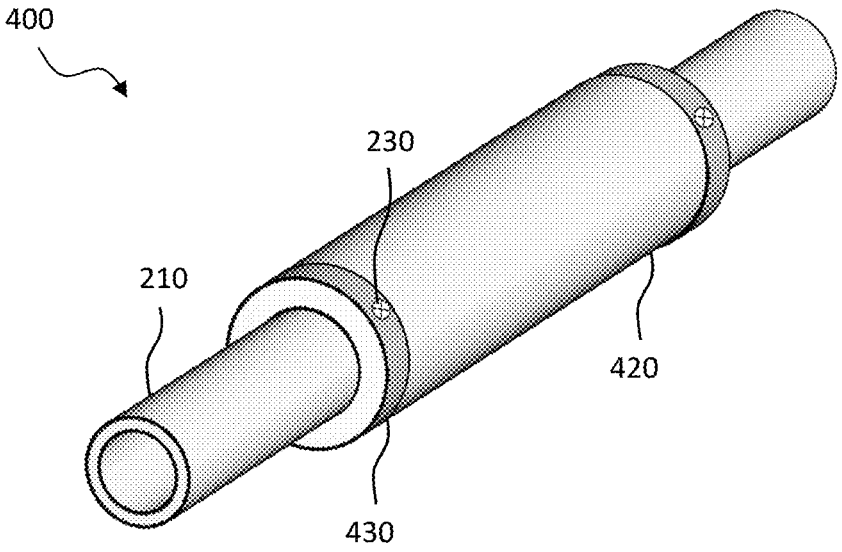

Turning briefly to FIG. 4, illustrated is an alternative embodiment of an expandable metal wellbore anchor 400. The expandable metal wellbore anchor 400 is similar in certain respects to the expandable metal wellbore anchor 200. Accordingly, like reference numerals have been used to reference similar, if not identical, features. The expandable metal wellbore anchor 400 includes a single elongate toroidal expandable member 420 positioned around the downhole conveyance member 210. The single elongate toroidal expandable member 420 may comprise one or more of the expandable metals discussed above. Moreover, the single elongate toroidal expandable member 420 need not have a circular opening our circular exterior, and thus could comprise a rectangle, another polygon, or any other suitable shape.

In the particular embodiment of FIG. 4, the single elongate toroidal expandable member 420 is held in place on the downhole conveyance 210 using a pair of retaining rings 430, for example positioned adjacent a proximal end and a distal end of the single elongate toroidal expandable member 420. In accordance with one embodiment of the disclosure, the pair of retaining rings does not comprise the metal configured to expand in response to hydrolysis, and moreover include one or more fasteners 230 for holding the single elongate toroidal expandable member 420 in place.

Figure 5:
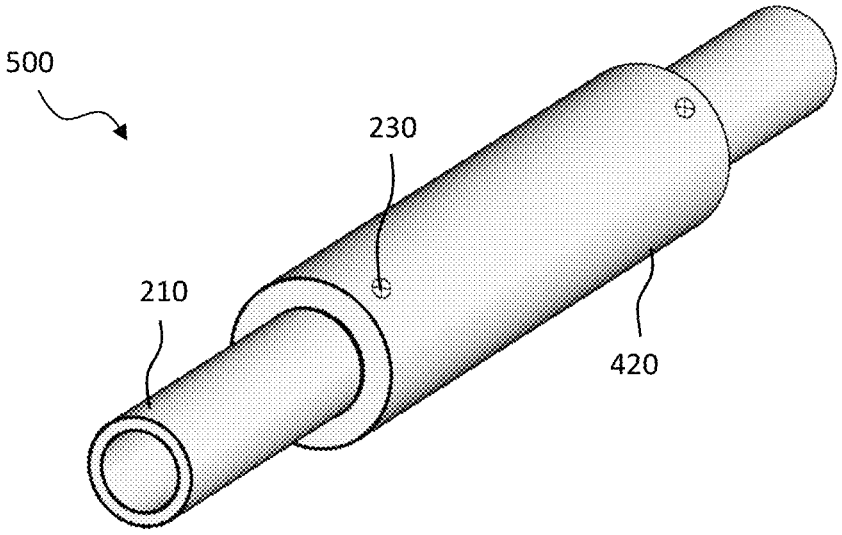

Turning briefly to FIG. 5, illustrated is an alternative embodiment of an expandable metal wellbore anchor 500. The expandable metal wellbore anchor 500 is similar in many respects to the expandable metal wellbore anchor 400. Accordingly, like reference numerals have been used to reference similar, if not identical, features. The expandable metal wellbore anchor 500 includes the single elongate toroidal expandable member 420 positioned around the downhole conveyance member 210. The expandable metal wellbore anchor 500, however, does not employ retaining rings 420. In contrast, the expandable metal wellbore anchor 500 positions the sets screws 230 directly in openings extending entirely through a wall thickness of the single elongate toroidal expandable member 420.

Figure 6:
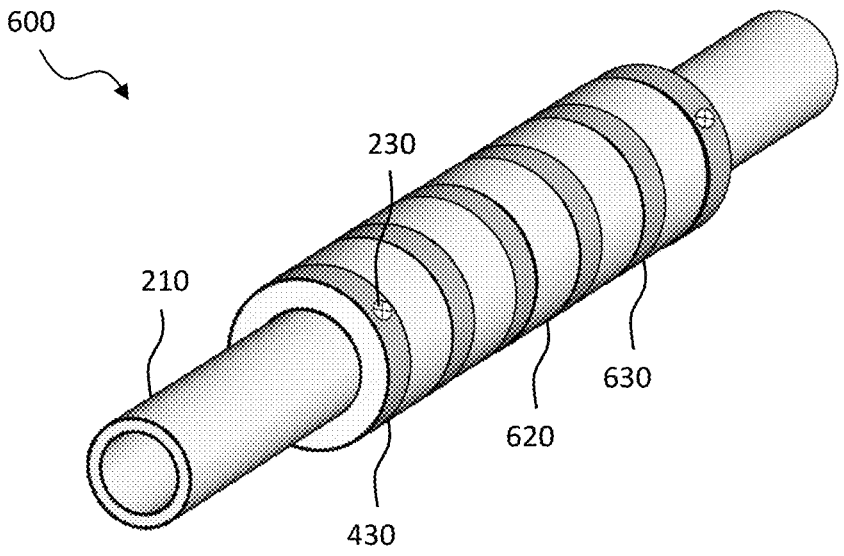

Turning briefly to FIG. 6, illustrated is an alternative embodiment of an expandable metal wellbore anchor 600. The expandable metal wellbore anchor 600 is similar in certain respects to the expandable metal wellbore anchor 400. Accordingly, like reference numerals have been used to reference similar, if not identical, features. The expandable metal wellbore anchor 600 includes two or more toroidal expandable members 620 positioned around the downhole conveyance member 210. In fact, in the embodiment of FIG. 6, five toroidal expandable members 620 are used. The two or more toroidal expandable members 620 may comprise one or more of the expandable metals discussed above.

The expandable metal wellbore anchor 600 illustrated in FIG. 6 additionally includes one or more spacers 630 axially interleaving the two or more toroidal expandable members 620. In the illustrated embodiment of FIG. 6, the one or more spacers 630 do not comprise the metal configured to expand in response to hydrolysis. The expandable metal wellbore anchor 600 additionally includes a pair of retaining rings 430. In accordance with one embodiment of the disclosure, the pair of retaining rings 430 does not comprise the metal configured to expand in response to hydrolysis, and moreover include one or more fasteners 230.

Figure 7:
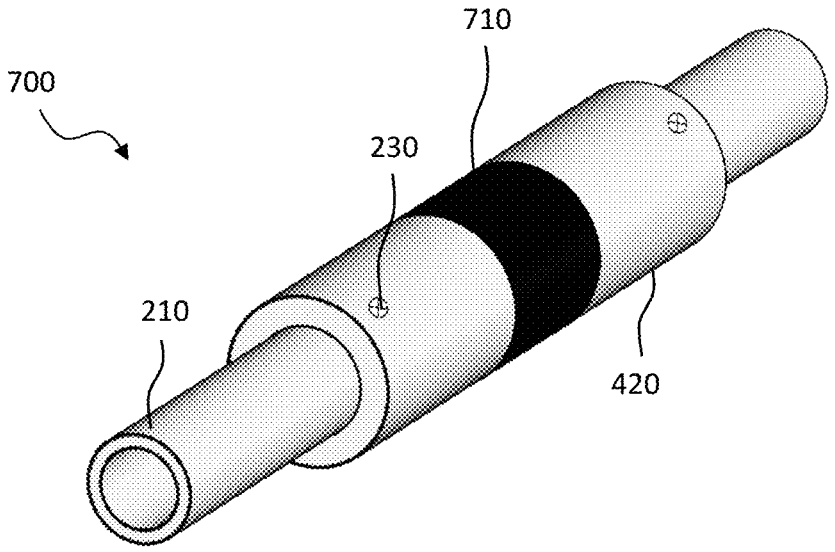

Turning briefly to FIG. 7, illustrated is an alternative embodiment of an expandable metal wellbore anchor 700. The expandable metal wellbore anchor 700 is similar in certain respects to the expandable metal wellbore anchor 500. Accordingly, like reference numerals have been used to reference similar, if not identical, features. The expandable metal wellbore anchor 700 additionally includes a swellable rubber member 710 positioned proximate the one or more expandable members 420. The swellable rubber member 710, in the illustrated embodiment, is configured to swell in response to contact with one or more downhole reactive fluids to pressure seal the wellbore, as well as function as a wellbore anchor. In one embodiment, the reactive fluid may be a diesel solution, or other similar water-based solution.

In the illustrated embodiment of FIG. 7, the swellable rubber member 710 is positioned between a pair of expandable members 420. In another embodiment, the swellable rubber member 710 could be placed around at least a portion of the one or more expandable members 420, and in yet another embodiment could be placed proximate an axial end of the one or more expandable members 420, among other locations.

Figure 8:
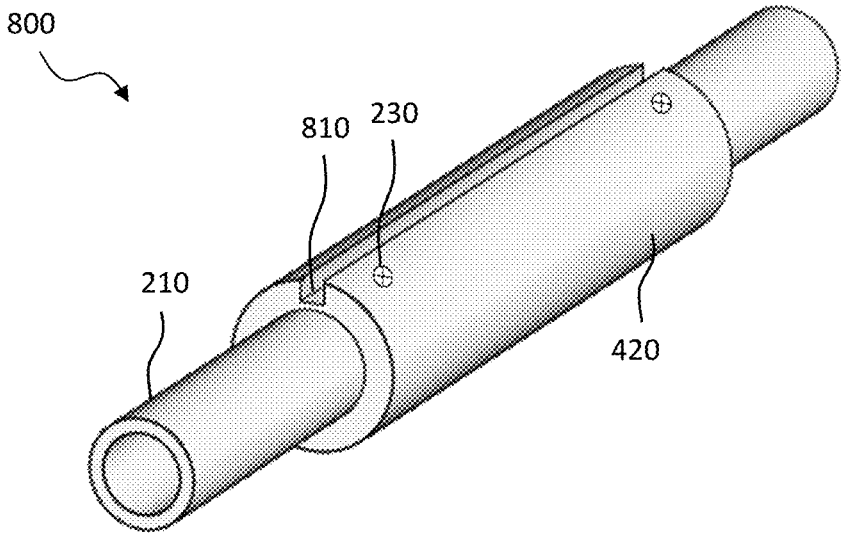

Turning briefly to FIG. 8, illustrated is an alternative embodiment of an expandable metal wellbore anchor 800. The expandable metal wellbore anchor 800 is similar in certain respects to the expandable metal wellbore anchor 500. Accordingly, like reference numerals have been used to reference similar, if not identical, features. The expandable metal wellbore anchor 800 additionally includes one or more axial grooves 810 extending along an entire length thereof. The axial groove 810 may comprise a variety of shapes and locations and remain within the scope of the present disclosure. In accordance with one embodiment of the disclosure, the one or more axial grooves 810 may be used to provide fluid flow past the expandable metal wellbore anchor 800, as well as act as a cable or other feature bypass (e.g., no splicing required) for the expandable metal wellbore anchor 800.

Figure 9:
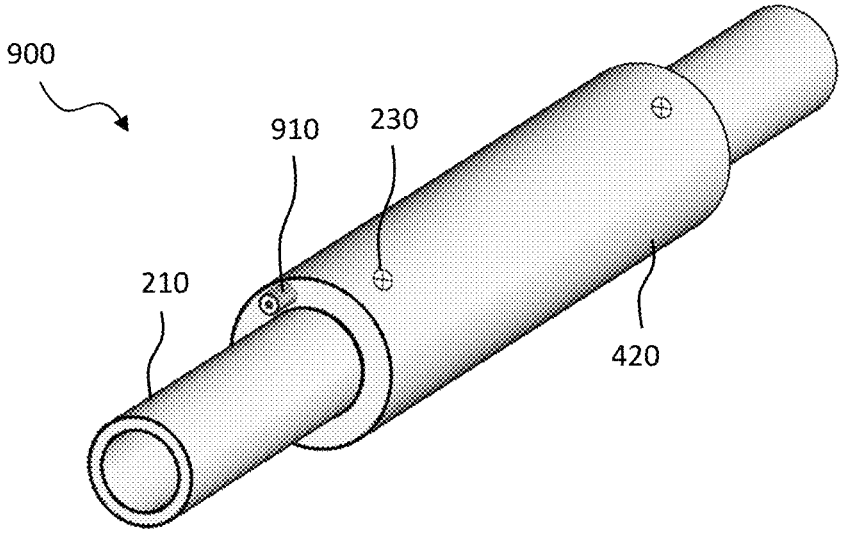

Turning briefly to FIG. 9, illustrated is an alternative embodiment of an expandable metal wellbore anchor 900. The expandable metal wellbore anchor 900 is similar in certain respects to the expandable metal wellbore anchor 500. Accordingly, like reference numerals have been used to reference similar, if not identical, features. The expandable metal wellbore anchor 900 additionally includes one or more passageways 910 (e.g., comprising one or more shunt tubes in one embodiment) extending along an entire length thereof. The one or more passageways 910, in accordance with the disclosure, provide fluid flow past the expandable metal wellbore anchor 900. In accordance with one embodiment, the one or more passageways 910 do not comprise the metal configured to expand in response to hydrolysis, and thus should remain open. In the illustrated embodiment of FIG. 9, the one or more passageways 910 are positioned in a wall thickness of the toroidal expandable member 420, but they could be in other locations, including the axial groove 810 discussed above with regard to FIG. 8.

Aspects disclosed herein include:

A. A expandable metal wellbore anchor for use in a wellbore, the expandable metal wellbore anchor including one or more expandable members positionable on a downhole conveyance member in a wellbore, wherein the one or more expandable members comprise a metal configured to expand in response to hydrolysis, and wherein a combined volume of the one or more expandable members is sufficient to expand to anchor one or more downhole tools within the wellbore in response to the hydrolysis.

B. A well system, the well system including 1) a wellbore positioned within a subterranean formation, 2) a downhole conveyance located within the wellbore, 3) an expandable metal wellbore anchor coupled to the downhole conveyance and expanded within the wellbore, the expandable metal wellbore anchor including one or more expandable members positioned on the downhole conveyance, and wherein the one or more expandable members comprise a metal configured to expand in response to hydrolysis, and 4) a downhole tool coupled to the expandable metal wellbore anchor, wherein a combined volume of the one or more expandable members is sufficient to expand to anchor the downhole tool within the wellbore in response to the hydrolysis.

C. A method for setting an expandable metal wellbore anchor, the method including 1) positioning a downhole conveyance at a desired location within a wellbore of a subterranean formation, the downhole conveyance having an pre-expansion expandable metal wellbore anchor coupled thereto, the pre-expansion expandable metal wellbore anchor including one or more expandable members positioned on the downhole conveyance, wherein the one or more expandable members comprise a metal configured to expand in response to hydrolysis, and wherein a combined volume of the one or more expandable members is sufficient to expand to anchor one or more downhole tools within the wellbore in response to the hydrolysis, and 2) subjecting the pre-expansion wellbore anchor to a wellbore fluid to expand the one or more expandable members into contact with the wellbore and thereby anchor the one or more downhole tool within the wellbore.

Aspects A, B, and C may have one or more of the following additional elements in combination: Element 1: wherein the one or more expandable members are two or more expandable members axially positionable along and substantially equally radially spaceable about the downhole conveyance member. Element 2: further including two or more spacers radially interleaving the two or more expandable members, wherein the two or more spacers do not comprise the metal configured to expand in response to hydrolysis. Element 3: wherein the one or more expandable members are one or more toroidal expandable members positionable around the downhole conveyance member in the wellbore. Element 4: further including a pair of retaining rings positioned adjacent a proximal end and a distal end of the one or more toroidal expandable members for fixing the one or more toroidal expandable members on the downhole conveyance member. Element 5: wherein the pair of retaining rings does not comprise the metal configured to expand in response to hydrolysis. Element 6: wherein the one or more toroidal expandable members positionable around the downhole conveyance member in the wellbore is a single elongate toroidal expandable member positionable around the downhole conveyance member in the wellbore. Element 7: wherein the single elongate toroidal expandable member further includes an opening extending entirely through a wall thickness thereof for accepting a fastener for fixing the single elongate toroidal expandable member on the downhole conveyance member. Element 8: wherein the one or more toroidal expandable members positionable around the downhole conveyance member in the wellbore include two or more toroidal expandable members positionable around the downhole conveyance member in the wellbore, and further including one or more spacers axially interleaving the two or more toroidal expandable members, wherein the one or more spacers do not comprise the metal configured to expand in response to hydrolysis. Element 9: wherein the one or more toroidal expandable members include an axial groove extending along an entire length thereof. Element 10: wherein the one or more toroidal expandable members include a passageway extending along an entire length thereof. Element 11: wherein the passageway is positioned in a wall thickness of the one or more toroidal expandable members. Element 12: further including a swellable rubber member positionable proximate the one or more expandable members, wherein the swellable rubber member is configured to swell in response to contact with one or more downhole fluids to seal the wellbore. Element 13: wherein the metal in its expanded state is porous, thereby allowing fluids within the wellbore to traverse past the wellbore anchor. Element 14: wherein a combined volume of the one or more expandable members is sufficient to expand to anchor at least about 11,000 Kg of weight within the wellbore. Element 15: wherein the expandable metal wellbore anchor is expanded within a cased region of the wellbore. Element 16: wherein the expandable metal wellbore anchor is expanded within an open hole region of the wellbore. Element 17: wherein the one or more expandable members are one or more toroidal expandable members positioned around the downhole conveyance member in the wellbore. Element 18: wherein the one or more toroidal expandable members include an axial groove extending along an entire length thereof. Element 19: wherein the one or more toroidal expandable members include a passageway extending along an entire length thereof. Element 20: wherein the passageway is positioned in a wall thickness of the one or more toroidal expandable members. Element 21: wherein the metal is configured to expand in response to one of magnesium hydrolysis, aluminum hydrolysis, calcium hydrolysis, and calcium oxide hydrolysis. Element 22: wherein hydrolysis forms a structure comprising one of a Brucite, Gibbsite, bayerite, and norstrandite. Element 23: wherein the metal is a magnesium alloy or a magnesium alloy alloyed with at least one of Al, Zn, Mn, Zr, Y, Nd, Gd, Ag, Ca, Sn, and Re.

Those skilled in the art to which this application relates will appreciate that other and further additions, deletions, substitutions and modifications may be made to the described embodiments.

What is claimed is:

1. An expandable metal wellbore anchor for use in a wellbore, comprising:

one or more conductive expandable members positionable on a downhole conveyance member in the wellbore;

wherein the one or more conductive expandable members comprise a metal configured to expand in response to hydrolysis; and wherein a combined volume of the one or more conductive expandable members is sufficient to expand to anchor one or more downhole tools having a combined weight of at least 11,000 Kg within the wellbore in response to the hydrolysis.

2. The expandable metal wellbore anchor as recited in claim 1, wherein the one or more expandable members are two or more expandable members axially positionable along and substantially equally radially spaceable about the downhole conveyance member.

3. The expandable metal wellbore anchor as recited in claim 2, further including two or more spacers radially interleaving the two or more expandable members, wherein the two or more spacers do not comprise the metal configured to expand in response to hydrolysis.

4. The expandable metal wellbore anchor as recited in claim 1, wherein the one or more conductive expandable members are one or more toroidal expandable members positionable around the downhole conveyance member in the wellbore.

5. The expandable metal wellbore anchor as recited in claim 4, further including a pair of retaining rings positioned adjacent a proximal end and a distal end of the one or more toroidal expandable members for fixing the one or more toroidal expandable members on the downhole conveyance member.

6. The expandable metal wellbore anchor as recited in claim 5, wherein the pair of retaining rings does not comprise the metal configured to expand in response to hydrolysis.

7. The expandable metal wellbore anchor as recited in claim 4, wherein the one or more toroidal expandable members positionable around the downhole conveyance member in the wellbore is a single elongate toroidal expandable member positionable around the downhole conveyance member in the wellbore.

8. The expandable metal wellbore anchor as recited in claim 7, wherein the single elongate toroidal expandable member further includes an opening extending entirely through a wall thickness thereof for accepting a fastener for fixing the single elongate toroidal expandable member on the downhole conveyance member.

9. The expandable metal wellbore anchor as recited in claim 4, wherein the one or more toroidal expandable members positionable around the downhole conveyance member in the wellbore include two or more toroidal expandable members positionable around the downhole conveyance member in the wellbore, and further including one or more spacers axially interleaving the two or more toroidal expandable members, wherein the one or more spacers do not comprise the metal configured to expand in response to hydrolysis.

10. The expandable metal wellbore anchor as recited in claim 4, wherein the one or more toroidal expandable members include an axial groove extending along an entire length thereof.

11. The expandable metal wellbore anchor as recited in claim 4, wherein the one or more toroidal expandable members include a passageway extending along an entire length thereof.

12. The expandable metal wellbore anchor as recited in claim 11, wherein the passageway is positioned in a wall thickness of the one or more toroidal expandable members.

13. The expandable metal wellbore anchor as recited in claim 1, further including a swellable rubber member positionable proximate the one or more expandable members, wherein the swellable rubber member is configured to swell in response to contact with one or more downhole fluids to seal the wellbore.

14. The expandable metal wellbore anchor as recited in claim 1, wherein the metal in its expanded state is inherently porous, thereby allowing fluids within the wellbore to traverse past the wellbore anchor.

15. A well system, comprising:

a wellbore positioned within a subterranean formation;

a downhole conveyance located within the wellbore, an expandable metal wellbore anchor coupled to the downhole conveyance and expanded within the wellbore, the expandable metal wellbore anchor including;

one or more conductive expandable members positioned on the downhole conveyance; and wherein the one or more conductive expandable members comprise a metal configured to expand in response to hydrolysis; and a downhole tool coupled to the expandable metal wellbore anchor, wherein a combined volume of the one or more expandable members is sufficient to expand to anchor the downhole tool having a combined weight of at least 11,000 Kg within the wellbore in response to the hydrolysis.

16. The well system as recited in claim 15, wherein the expandable metal wellbore anchor is expanded within a cased region of the wellbore.

17. The well system as recited in claim 15, wherein the expandable metal wellbore anchor is expanded within an open hole region of the wellbore.

18. The well system as recited in claim 15, wherein the one or more conductive expandable members are one or more toroidal expandable members positioned around the downhole conveyance member in the wellbore.

19. The well system as recited in claim 18, wherein the one or more toroidal expandable members include an axial groove extending along an entire length thereof.

20. The well system as recited in claim 18, wherein the one or more toroidal expandable members include a passageway extending along an entire length thereof.

21. The well system as recited in claim 20, wherein the passageway is positioned in a wall thickness of the one or more toroidal expandable members.

22. A method for setting an expandable metal wellbore anchor, comprising:

positioning a downhole conveyance at a desired location within a wellbore of a subterranean formation, the downhole conveyance having a pre-expansion expandable metal wellbore anchor coupled thereto, the pre-expansion expandable metal wellbore anchor including;

one or more conductive expandable members positioned on the downhole conveyance;

wherein the one or more conductive expandable members comprise a metal configured to expand in response to hydrolysis; and wherein a combined volume of the one or more conductive expandable members is sufficient to expand to anchor one or more downhole tools having a combined weight of at least 11,000 Kg within the wellbore in response to the hydrolysis; and subjecting the pre-expansion wellbore anchor to a wellbore fluid to expand the one or more expandable members into contact with the wellbore and thereby anchor the one or more downhole tool within the wellbore.

23. The method as recited in claim 22, wherein the metal is configured to expand in response to one of magnesium hydrolysis, aluminum hydrolysis, calcium hydrolysis, and calcium oxide hydrolysis.

24. The method as recited in 24, wherein the hydrolysis forms a structure comprising one of a Brucite, Gibbsite, bayerite, and norstrandite.

25. The method as recited in claim 22, wherein the metal is a magnesium alloy or a magnesium alloy alloyed with at least one of the following elements: Al, Zn, Mn, Zr, Y, Nd, Gd, Ag, Ca, Sn, and Re.

* * * * *